US006212345B1

(12) United States Patent
Harada et al.

(10) Patent No.: US 6,212,345 B1
(45) Date of Patent: Apr. 3, 2001

(54) IMAGE FORMING APPARATUS WITH DIFFERENT INERTIAL CONDITIONS AMONG IMAGE SUPPORTS

(75) Inventors: Yoshikazu Harada; Kyosuke Taka, both of Nara; Toshio Yamanaka, Yao; Nobuo Manabe, Yamatokoriyama; Hidekazu Sakagami, Sakurai; Ayumu Oda, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/484,507

(22) Filed: Jan. 18, 2000

(30) Foreign Application Priority Data

Feb. 17, 1999 (JP) ..... 11-038253

(51) Int. Cl.[7] ..... G03G 15/00; G03G 15/01

(52) U.S. Cl. ..... 399/159; 399/167; 399/299

(58) Field of Search ..... 399/159, 299, 399/109, 167; 347/115, 232

(56) References Cited

U.S. PATENT DOCUMENTS 5,528,341 * 6/1996 Shishido et al. ..... 399/109

FOREIGN PATENT DOCUMENTS 4-147279 5/1992 (JP) .
6-332289 * 12/1994 (JP) .
8-194354 7/1996 (JP) .

* cited by examiner

*Primary Examiner*—Susan S. Y. Lee
(74) *Attorney, Agent, or Firm*—Renner, Otto, Boisselle & Sklar

(57) ABSTRACT

In an image forming apparatus wherein a multiple number of image supports form developer images of different colors so that the developer images of different colors corresponding to the multiple number of image supports are superimposed to a recording medium to form an image, flywheels are set at the ends of the rotary shafts of multiple image supports corresponding to relatively highly visible colors while no flywheel or a flywheel having a different diameter or weight from that of the above is set for the image support corresponding to a less visible color so as to make the inertial condition different from that of the others.

7 Claims, 5 Drawing Sheets

IMAGE FORMING APPARATUS WITH DIFFERENT INERTIAL CONDITIONS AMONG IMAGE SUPPORTS

BACKGROUND OF THE INVENTION (1) Field of the Invention

The present invention belongs to the technical field of image forming apparatus in which an image is formed by conveying a predetermined recording medium along a plurality of image supports arranged in parallel to each other so as to sequentially and superimposingly transfer the developed images on individual image supports to the recording medium. More detailedly, the present invention relates to an image forming apparatus of the so-called tandem type having a plurality of image supports each having a rotational inertial body such as a flywheel or the like at one end of their rotary shafts.

(2) Description of the Prior Art

In general, in conventional image forming apparatus for recording designated image information by performing linewise scanning such as laser scanning on an image support such as a phtoreceptor, drive irregularity occurs in the driving mechanism for rotating the image support. When an image of lines is recorded, this drive irregularity will cause image unevenness (so-called banding) which is made up of bands in the final image on the recording medium.

In order to solve the above problem, a rotating inertial body such as a flywheel has been provided at one end of the rotary shaft of the image support. That is, in an attempt to reduce the drive irregularity originating from the driving mechanism, a heavy, rotating inertial body has been provided to produce the desired inertia for the rotation of the image support.

On the other hand, in the field of image forming apparatus, there has been a development towards multicolorization of recorded images. A known typical example of color image forming apparatus is the so-called tandem type having multiple image supports therein. In such a color image forming apparatus, when a developed image of a relatively more visible color on the image support deviates from the correct position due to drive irregularity, color blur occurs in each developed image even if the deviation is slight. Therefore, it is necessary to establish rotational synchronism between individual image supports, so that rotational inertial bodies of an identical type need to be provided for all the multiple, image supports in order to take into account the rotational drive irregularity of the image supports.

Accordingly, in an image forming apparatus having multiple image supports, provision of rotational inertial bodies of an identical type for all the multiple image supports increases the number of assembly parts, hence causing various problems including: lowering of design flexibility, increase in the manufacturing cost, making the apparatus bulky hence the needing of a large space for installation, and increase in the machine weight hence rise in the cost for transportation.

Japanese Patent Application Laid-Open Hei 4 No.147279 has proposed a technique that reliably establishes synchronized rotations of all the image supports in an image forming apparatus of the so-called tandem type while preventing bulkiness of the apparatus. That is, in this configuration, the rotational inertial bodies are made up of an non-circular shape having the same inertia and attached on the rotational shafts of all the image supports to thereby reduce the distance between image supports.

As above, in the tandem type, image forming apparatus of Japanese Patent Application Laid-Open Hei 4 No.147279, the rotational inertial bodies provided on the rotational shafts of all the image supports, have the same, non-circular sectional feature in order to equally increase the inertia of all the image supports, whereby it is possible to reduce the distance between image supports, and hence this configuration contributes to securing reliable synchronized rotations of multiple image supports whilst minimizing the size of the image forming apparatus.

It is true that the technology described above can shorten the distance between image supports and inhibit the bulkiness of the apparatus as a whole, compared to the conventional configuration where circular rotational inertial bodies are arranged in parallel, but it still suffers from unsolved problems of increase in the manufacturing cost and apparatus weight due to increase in the number of assembly parts since the rotational inertial bodies of the same type are needed for all the image supports. Further, this configuration is limited by the complex shape of the rotational inertial bodies and their arrangement and also by the necessity of a control means and the like for exactly controlling the rotational positions of the rotational inertial bodies so as not to interfere with each other. Thus, there are sill unsolved problems such that design flexibility is markedly hindered.

SUMMARY OF THE INVENTION

The present invention has been devised in order to solve the above prior art problems and it is therefore an object of the present invention to provide an image forming apparatus which is free from various problems such as of the apparatus becoming bulky, the increase in the manufacturing cost, the increase in apparatus' weight and degradation of design flexibility while preventing deviations of images due to drive irregularities of the image supports from being recognized by the user by differentiating the inertial conditions for designated image supports among the multiple image supports from the others.

The present invention has been devised to achieve the above object, and the present invention is configured as follows:

In accordance with the first aspect of the present invention, an image forming apparatus wherein a multiple number of image supports form developer images of different colors so that the developer images of different colors corresponding to the multiple number of image supports are superimposed one over another onto a recording medium to form an image, is characterized in that the inertial condition of a predetermined image support among the multiple number of image supports is made different from that of the other image supports.

In accordance with the second aspect of the present invention, the image forming apparatus having the above first feature is characterized in that the other image supports have identical rotational inertial bodies at their rotary shaft ends while the predetermined image support has no rotational inertial body or a rotational inertial body which is different in diameter or in weight, at the rotary shaft end thereof.

In accordance with the third aspect of the present invention, the image forming apparatus having the above first feature is characterized in that the color of the developer for the image support for which the inertial condition is made different from that of the others is one which is less visible in the final image, among the developers of the specified colors.

In accordance with the fourth aspect of the present invention, the image forming apparatus having the above second feature is characterized in that the color of the developer for the image support for which the inertial condition is made different from that of the others is one which is less visible in the final image, among the developers of the specified colors.

In accordance with the fifth aspect of the present invention, the image forming apparatus having the above first feature is characterized in that the moment of rotation of the rotational inertial bodies of the other image supports is set greater than that of the rotational inertial body of the predetermined image support.

In accordance with the sixth aspect of the present invention, the image forming apparatus having the above third feature is characterized in that the developer that is less visible is of yellow.

In accordance with the seventh aspect of the present invention, the image forming apparatus having the above fourth feature is characterized in that the developer that is less visible is of yellow.

DESCRIPTION OF THE PREFERRED EMBODIMENTS

The image forming apparatus according to the embodiment of the present invention uses flywheels each having a projected portion in the center thereof, formed by drawing or another process, as rotational inertial bodies for creating inertia for rotations of photoreceptors (image supports) in the recording units for different colors. Each flywheel has a hollowed out portion on the side opposite to the projection. These flywheels are attached to the rotary shaft ends of the photoreceptors arranged in parallel with each other with their sides alternated, so as to inhibit occurrence of drive irregularity of these photoreceptors.

To begin with, a case where the image forming apparatus of the embodiment of the present invention is applied to a tandem type digital copier 1 is explained. Overall configuration of digital copier 1 is described with reference to FIG. 1.

Figure 1:
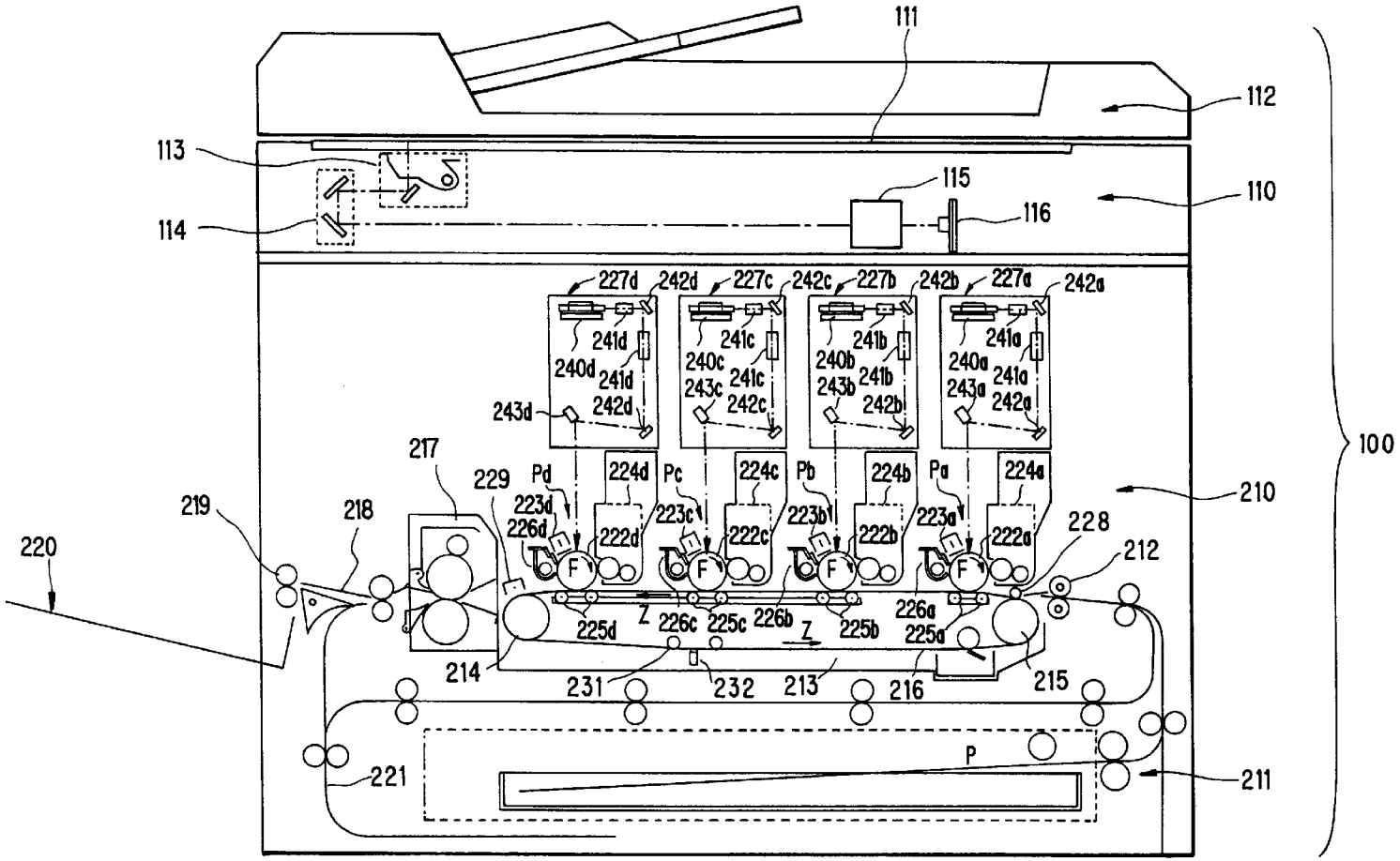
FIG. 1 is an overall view showing a digital color copier in accordance with the embodiment of the present invention.
Figure 2:
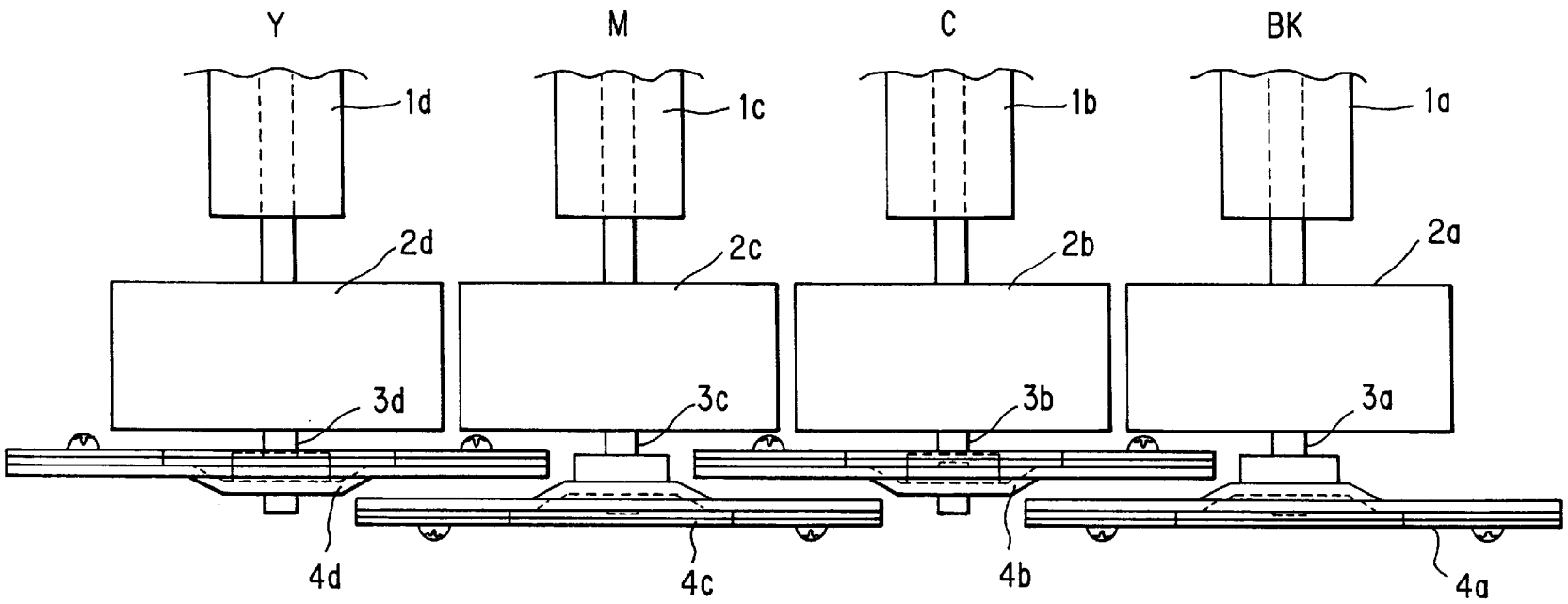
FIG. 2 PRIOR ART
FIG. 2 is a plan view for illustrating the arrangement of flywheels in the image forming portion in accordance with the prior art.
Figure 3:
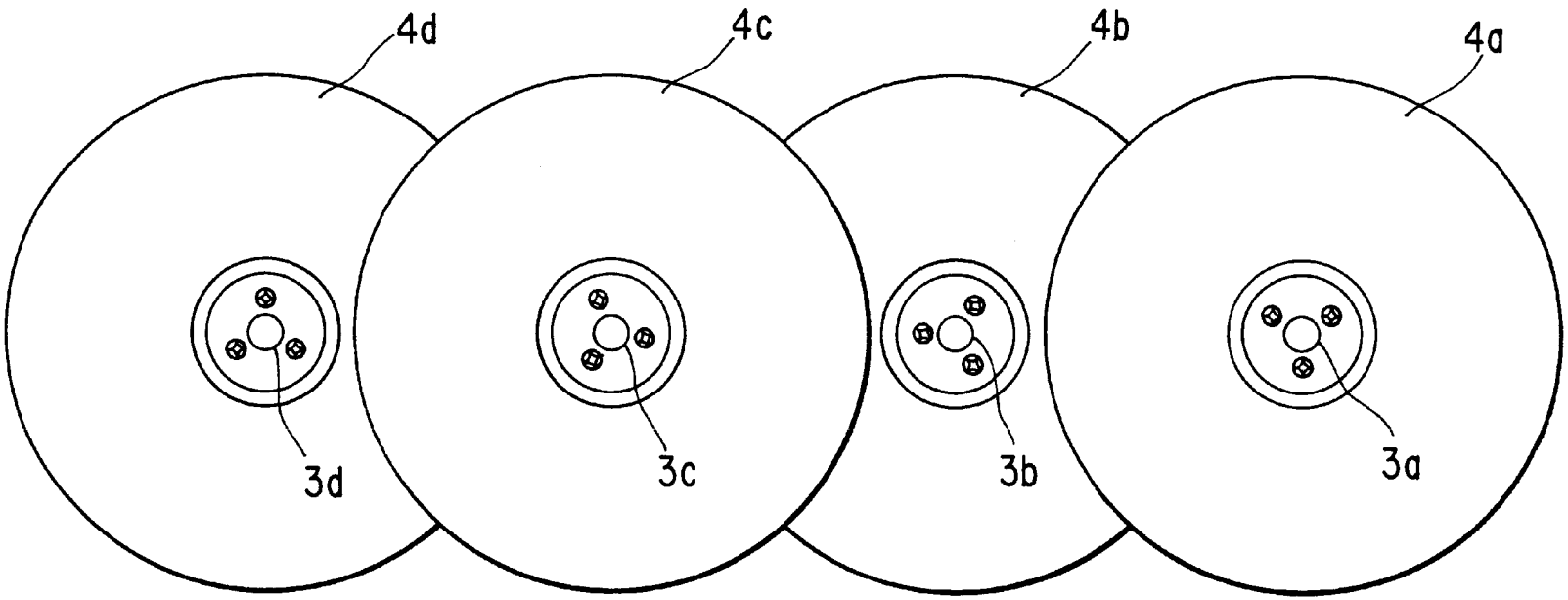
FIG. 3 PRIOR ART
FIG. 3 is a front view for illustrating the arrangement of flywheels in the image forming portion in accordance with the prior art.

FIG. 1 is an overall front sectional view showing the configuration of a digital color copier 100 as the image forming apparatus of the embodiment of the present invention.

Copier body 100 has an original table 111 and a control panel on the top thereof and has an image reading portion 110 and an image forming unit 210 within. A recirculating automatic document feeder (RADF) 112 is arranged on the top surface of original table 111 in the predetermined position with resect to the original table 111 surface, whilst being supported so as to be opened and closed relative to original table 111.

RADF 112, first, conveys an original so that the one side of the original opposes image reading portion 110 at the predetermined position on original table 111. After the image scanning of this side has been completed, the original is inverted and conveyed to original table 111 so that the other side opposes image reading portion 110 at the predetermined position on original table 111. Then, when RADF 112 completes image scanning of both sides of one original, the original is discharged and the duplex copy conveying operation for a next document is effected. The operation of conveyance and face inversion of the original is controlled in association with the whole operation of digital color copier 110.

Image reading portion 110 is disposed below original table 111 in order to read the image of the original conveyed onto original table 111 by means of RADF 112. Image reading portion 110 includes original scanning portion 113 and 114 which reciprocates along, and in parallel to, the undersurface of original table 111, an optical lens 115 and a CCD line sensor 116 as a photoelectric converting device.

This original scanning portion 113 and 114 is composed of first and second scanner units 113 and 114. First scanner unit 113 has an exposure lamp for illuminating the original image surface and a first mirror for deflecting the reflection image of light from the original toward the predetermined direction and moves in a reciprocating manner in parallel with, whilst being kept a certain distance away from, the undersurface of original table 111 at the predetermined speed. Second scanner unit 114 has second and third mirrors which deflect the reflected light image from the original, deflected by first mirror of first scanner unit 113 toward the predetermined direction and moves in a reciprocating manner at a speed related to that of first scanner unit 113 and in parallel thereto.

Optical lens 115 reduces the reflected light image from the original, thus deflected by third mirror of second scanner unit 114, so that the reduced light image will be focused on the predetermined position on CCD line sensor 116.

CCD line sensor 116 photoelectrically converts the focused light image sequentially into an electric signal and outputs it. CCD line sensor 116 is a three-line color CCD which can read monochrome or color images and output line data as to color separation components R(red), G(green) and B(blue). The original image information thus obtained as the electric signal from this CCD line sensor 116 is further transferred to an unillustrated image processor where the predetermined image data processes are performed.

Next, the configuration of image forming unit 210 and the configuration of the components related to image forming portion 210 will be described.

Provided below image forming portion 210 is a paper feeding mechanism 211 which separates a sheet of paper (recording medium) P, one by one, from a stack of paper held in a paper tray and feeds it toward image forming portion 210. The paper P thus separated and fed sheet by sheet is delivered into image forming portion 210 with its timing controlled by a pair of registration rollers 212 located before image forming portion 210. The paper P with an image formed on its one side is conveyed and re-fed to image forming portion 210 in time with image forming of image forming portion 210.

Arranged under image forming portion 210 is a conveyer and transfer belt mechanism 213. Conveyer and transfer belt mechanism 213 is composed of a driving roller 214, an idle roller 215 and a conveyer and transfer belt 216 wound and tensioned in parallel between the two rollers so as to convey paper P being attracted to the belt by electrostatic force. Further, an unillustrated pattern image detecting unit is provided under and in proximity to conveyer and transfer belt 216.

Arranged in the paper conveyance path, downstream of conveyer and transfer belt mechanism 213 is a fixing unit 217 for fixing the toner image (developer image) onto paper P which has been transferred on paper P. Paper P having passed through the nip between a pair of fixing rollers of fixing unit 217 passes through a conveyance direction switching gate 218 and is discharged by discharge rollers 219 to a paper output tray 220 attached to the outer wall of copier body 100.

This switching gate 218 selectively connects the conveyance path of paper P after fixing with either the path to discharge paper P to the outside of copier body 100 or the path to recirculate paper P toward image forming portion 210. The paper P which is designated to be conveyed again to image forming portion 210 by means of switching gate 218 is inverted by means of a switch-back conveyance path 221 and then re-fed to image forming portion 210.

Arranged above, and in proximity to, conveyer and transfer belt 216 in image forming portion 210 are the first image forming station Pa, the second image forming station Pb, the third image forming station Pc and the fourth image forming station Pd, in the above mentioned order from the upstream side of the paper conveyance path.

Conveyer and transfer belt 216 is frictionally driven by driving roller 214 in the direction indicated by arrow Z in FIG. 1, and carries paper P which is fed by paper feeding mechanism 211 as stated above and sequentially conveys it to image forming stations Pa to Pd.

All the image forming stations Pa to Pd are of a substantially identical configuration. Each image forming station Pa, Pb, Pc and Pd has a photoreceptor drum 222*a*, 222*b*, 222*c* and 222*d*, which is driven in the rotational direction indicated by arrow F in FIG. 1.

Provided around each photoreceptor drum 222*a* to 222*d*, are a primary charger 223*a*, 223*b*, 223*c* and 223*d* for uniformly charging photoreceptor drum 222*a*–222*d*, a developing unit 224*a*, 224*b*, 224*c* and 224*d* for developing the static latent image formed on photoreceptor drum 222*a*–222*d*, a transfer charger 225*a*, 225*b*, 225*c* and 225*d* for transferring the developed toner image on photoreceptor drum 222*a*–222*d* to paper P, a cleaning unit 226*a*, 226*b*, 226*c* and 226*d* for removing the leftover toner from photoreceptor drum 222*a*–222*d*, in this order with respect to the rotational direction of each photoreceptor drum 222*a*–222*d*.

Arranged above photoreceptor drums 222*a* to 222*d* are laser beam scanner units 227*a*, 227*b*, 227*c* and 227*d*, respectively. Each laser scanner unit 227*a*–227*d* includes: a semiconductor laser element (not shown) for emitting a spot beam modulated in accordance with the image data; a polygon mirror (deflecting device) 240*a*–240*d* for deflecting the laser beam from the semiconductor laser element, in the main scan direction; an f-theta lens 241*a*–241*d* for focusing the laser beam deflected by polygon mirror 240*a*–240*d* on the surface of photoreceptor drum 222*a*–222*d*; and mirrors 242*a*–242*d* and 243*a*–243*d*.

The pixel signal corresponding to the black component image of a color original image is supplied to laser beam scanner unit 227*a*; the pixel signal corresponding to the cyan color component image of a color original image is supplied to laser beam scanner unit 227*b*; the pixel signal corresponding to the magenta color component image of a color original image is supplied to laser beam scanner unit 227*c*; and the pixel signal corresponding to the yellow color component image of a color original image is supplied to laser beam scanner unit 227*d*.

In this arrangement, the static latent images corresponding to the color separations of the original image information are formed on photoreceptor drums 222*a* to 222*d*. Developing units 224*a*, 224*b*, 224*c* and 224*d* hold black toner, cyan color toner, magenta color toner, yellow color toner, respectively. The static latent image on photoreceptor drum 222*a*–222*d* is developed by the toner of a corresponding color. Thus, the color separations of the original image information are reproduced in image forming portion 210 as toner images (developed images) of different colors.

Provided between the first image forming station Pa and paper feeding mechanism 211 is a paper-attraction charger 228, which electrifies the conveyer and transfer belt 216 surface so that paper P fed from paper feeding mechanism 211 can be conveyed without any slip or slide, whilst being reliably attracted to conveyer and transfer belt 216, from the first image forming station Pa to the fourth image forming station Pd.

An erasing device (not shown) is arranged approximately directly above driving roller 214 located between the fourth image forming station Pd and fixing roller 217. Applied to this erasing device is an alternating current for separating paper P from the belt, which has been electrostatically attracted to conveyer and transfer belt 216.

In the thus configured digital color copier, cut-sheet type paper is used as paper P. When paper P is delivered from the paper feed cassette to the guide of the paper conveyance path of paper feeding mechanism 211, the leading edge of paper P is detected by a sensor (not shown), which outputs a detection signal, based on which a pair of registration rollers 212 briefly stops the paper.

Then, paper P is delivered in synchronization with image forming stations Pa to Pd, onto conveyer and transfer belt 216 rotating in the direction of arrow Z in FIG. 1. Meanwhile, conveyer and transfer belt 216 has been charged in a predetermined manner by paper attraction charger 228 as stated above, so that paper P is stably fed and conveyed throughout the passage of all the image forming stations Pa to Pd.

In each image forming station Pa-Pd, the toner image of each color is formed so that the different color images are superimposed on the support surface of paper P which is conveyed whilst being electrostatically attracted by conveyer and transfer belt 216. When transfer of the image formed by the fourth image forming station Pd is completed, paper P is continuously separated by virtue of an unillustrated negative electricity discharger, starting at its leading edge, from conveyer and transfer belt 216 and introduced into fixing unit 217. Finally, paper P having the toner image fixed thereon is discharged through the paper discharge port (not shown) onto paper output tray 220.

In the above description, writing to the photoreceptor is performed by laser beam scanning exposure using laser beam scanner unit 227*a*–227*d*. However, instead of the laser beam scanner unit, another type of optical writing system array (LED head) made up of a light emitting diode array with a focusing lens may be used. An LED head is smaller in size compared to a laser beam scanner unit and has no moving parts hence is silent. Therefore, this LED head can be preferably used for image forming apparatus such as digital color copiers of a tandem type needing multiple optical writing units.

Next, the features of the image forming apparatus according to the present invention will be described with reference to an example of a conventional configuration.

In digital image forming apparatus 100, each photoreceptor 1 (1*a*–1*d*) in image forming portion 210 has a gear box 2 (2*a*–2*d*), a shaft 3 (3*a*–3*d*), a flywheel (rotational inertial body) 4 (4*a*–4*d*).

Gear box 2 is configured of an unillustrated drive gear and drive motor etc., to rotationally drive photoreceptor 1. Gear box 2 and shaft 3 at least make up a drive mechanism of photoreceptor 1. In general, gears in gear box 2 mesh with one another with some play which allows relative rotation therebetween. This play may cause drive irregularity of photoreceptor 1 and produce band-like image unevenness called banding as stated above, in the finally developed image formed on the recording medium.

In order to enhance the inertia of the rotation of photoreceptor 1 and hence smoothen the rotation of photoreceptor 1, flywheel 4 as a rotational inertial body is fixed to rotational shaft 3 of photoreceptor 1, thus making it possible to prevent the occurrence of drive irregularity of photoreceptor 1 and hence avoid the occurrence of the banding.

The inertia derived from this flywheel 4 with regards to the rotation of photoreceptor 1 usually depends upon the diameter of the flywheel if the same and uniform material is used. Specifically, with increase in diameter of flywheel 4, the inertial force acting on photoreceptor 1 becomes greater (therefore, the weight becomes heavier).

In the digital color copier 100 of this embodiment, multiple recording units, i.e., black (Bk) recording unit, cyan (C) recording unit, magenta (M) recording unit and yellow (Y) recording unit are arranged in this order from the right in the drawing along the paper P (recording medium) conveyance path. Among these, flywheel (rotational inertial body) 4 on the photoreceptor drive shaft in the yellow image recording unit is removed (see FIGS. 4 and 5) since this yellow color is relatively less recognizable to human eyes.

That is, among multiple colors (cyan, magenta, yellow and black) constituting the recording portion, yellow is the least visible to human eyes and relatively less recognizable. Therefore, if drive irregularity occurs to some degree, the blur is less recognized compared to that of other colors.

Here, this embodiment has been described when it is applied to a digital color copier of black, cyan, magenta and yellow, but the color of the recording portion from which a flywheel is removed should not be limited to yellow. That is, the flywheel can be removed from any recording unit corresponding to a color which is less recognizable.

That is, if the apparatus uses image recording units of additional colors or image recording units of a different combination of colors, it is possible to remove the flywheel from a recording portion using a color which is the least visible to human eyes.

Figure 4:
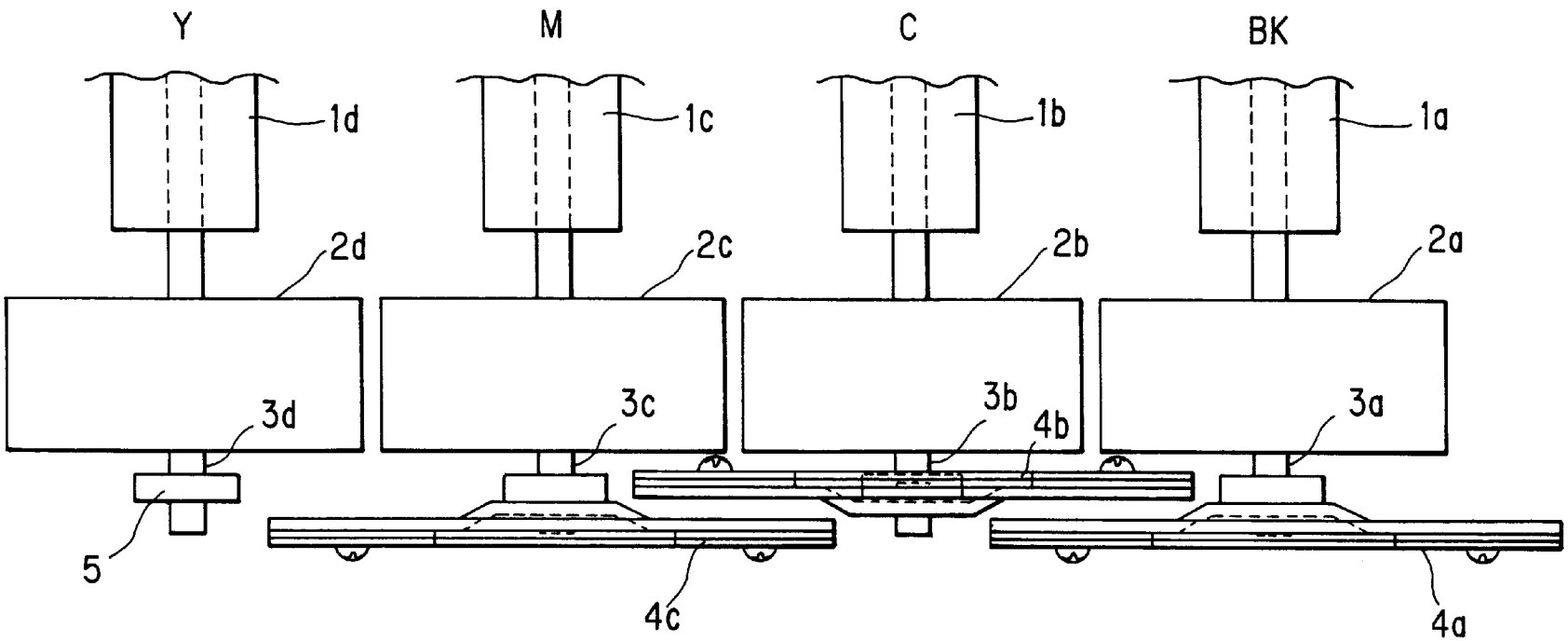
FIG. 4 is a plan view for illustrating the arrangement of flywheels in the image forming portion in accordance with the present invention.
Figure 5:
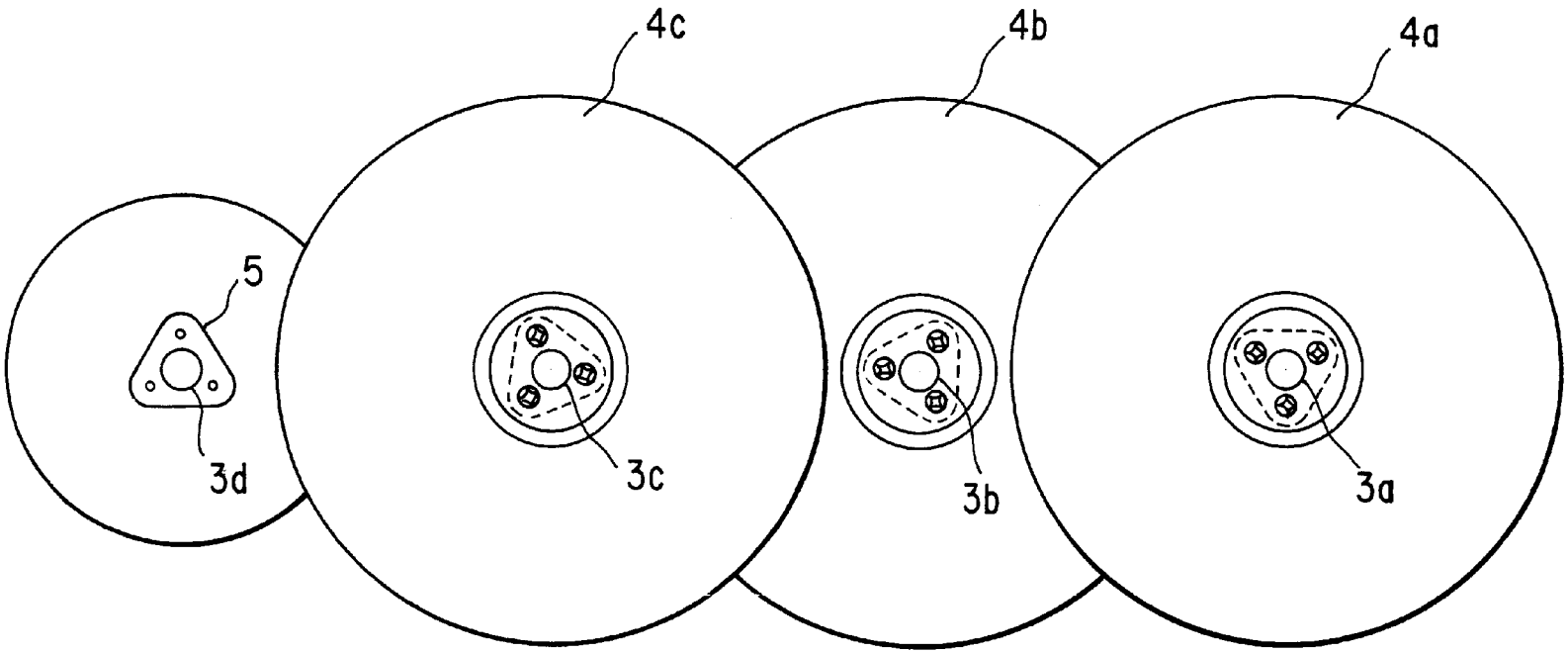
FIG. 5 is a front view for illustrating the arrangement of flywheels in the image forming portion in accordance with the present invention.

As is shown in FIGS. 4 and 5, rotary shaft 3*d* of photoreceptor ld which has no flywheel (rotational inertial body) 4*d* thereon still has a supporter 5 for attachment of a flywheel 4*d*. This is a consideration in complying with the request for the flywheel to be attached on site when the user's priority takes that of image quality even if the color is less visible to human eyes, or when images in which the less visible color to human eyes is conspicuous are frequently used or other cases.

The example in the description of the above embodiment was a configuration in which the photoreceptor for recording the image of a particular color (a color less visible to human eyes) has no flywheel 4 on its rotary shaft. However, the photoreceptor may have a flywheel 4 which has a different inertia from that of other flywheels 4 attached on the other photoreceptor rotary shafts. Further, the particular color should not be limited to one. Needless to say, if one or more colors are less visible, no rotational inertial body or that having a smaller inertia may be attached for the plurality of colors.

Further, in order to change the inertial conditions, a flywheel having a smaller diameter than the others or being lighter (use of lightweight material, use of a lower number of supported wheel metal sheets, reduction in volume by changing the sectional shape) may be set.

In the above embodiment, the inertial conditions are made different for the image support corresponding to a developer color less visible among the specified developer colors. However, the present invention should not be limited thereto. For example, among the image supports for colors of developers, the one which is less frequently used may be changed in inertial conditions. In this case, allowance of a limited image deviation enables reduction in parts cost, manufacturing cost, transportation cost as well as makes the apparatus compact, contributing to reduction of the footprint of the apparatus.

In the conventional image forming apparatus having multiple image supports, a rotational inertial body is provided for each image support so as to prevent degradation of image quality due to drive irregularity. Therefore, increase in the number of assembly parts leads to various problems including: lowering of design flexibility, increase in the manufacturing cost, making the apparatus bulky and hence the needing of a large space for installation, and increase in the machine weight hence rise in the cost for transportation. In the present invention, since the inertial condition for a particular image support among multiple number of image supports is made different from that of others, it is possible to reduce the number of parts or reduce the size of parts when changing the inertial conditions, thus leading to cutting down the parts cost, manufacturing cost and transportation cost while minimizing the footprint by making the apparatus compact.

In accordance with the present invention, simple configuration makes it possible to reduce drive irregularity of the image supports while eliminating the conventional problems which would derive from increase in the number of assembly parts, including: lowering of design flexibility, increase in the manufacturing cost, making the apparatus bulky hence the needing of a large space for installation, and increase in the machine weight hence rise in the cost for transportation.

In accordance with the present invention, it is possible to reduce drive irregularity of the image supports while minimizing the influence on the finally recorded image and eliminating the conventional problems which would derive from increase in the number of assembly parts, including: lowering of design flexibility, increase in the manufacturing cost, making the apparatus bulky and hence the needing of a large space for installation, and increase in the machine weight hence rise in the cost for transportation.

In accordance with the present invention, when two types of rotational inertial bodies of the same weight are used: one having its center of gravity located outwards and the other having its center of gravity located inwards, the same effects as above can be obtained.

What is claimed is:

1. An image forming apparatus wherein a multiple number of image supports form developer images of different colors so that the developer images of different colors corresponding to the multiple number of image supports are superimposed one over another onto a recording medium to form an image, characterized in that an inertial condition of a predetermined image support among the multiple number of image supports is made different from that of the other image supports.

2. The image forming apparatus according to claim 1, wherein the other image supports have identical rotational inertial bodies at their rotary shaft ends while the predetermined image support has no rotational inertial body or a rotational inertial body which is different in diameter or in weight, at the rotary shaft end thereof.

3. The image forming apparatus according to claim 1, wherein a color of a developer for the image support for which the inertial condition is made different from that of the others is one which is less visible in a final image, among the colors of the developers for the other image supports.

4. The image forming apparatus according to claim 2, wherein a color of a developer for the image support for which the inertial condition is made different from that of the others is one which is less visible in a final image, among the colors of the developers for the other image supports.

5. The image forming apparatus according to claim 1, wherein a moment of rotation of rotational inertial bodies of the other image supports is set greater than that of rotational inertial body of the predetermined image support.

6. The image forming apparatus according to claim 3, wherein the developer that is less visible is of yellow.

7. The image forming apparatus according to claim 4, wherein the developer that is less visible is of yellow.

* * * * *